US005375782A

United States Patent [19]

Schwelling

[11] Patent Number: 5,375,782

[45] Date of Patent: Dec. 27, 1994

[54] PAPER SHREDDER

[76] Inventor: Hermann Schwelling, Hartmannweg 5, D-88682 Salem, Germany

[21] Appl. No.: 209,839

[22] Filed: Mar. 11, 1994

[30] Foreign Application Priority Data

Mar. 22, 1993 [DE] Germany ..... 4309091
Nov. 19, 1993 [DE] Germany ..... 4339336

[51] Int. Cl.[5] ..... B02C 18/06; B02C 18/16
[52] U.S. Cl. ..... 241/166; 241/236
[58] Field of Search ..... 241/166, 167, 236

[56] References Cited

U.S. PATENT DOCUMENTS

| | | | |
|---|---|---|---|
| 4,018,392 | 4/1977 | Wagner | 241/167 |
| 4,562,971 | 1/1986 | Schwelling | 241/236 |
| 4,688,730 | 8/1987 | Dahle | 241/166 |
| 4,693,428 | 9/1987 | Raterman et al. | 241/167 |
| 4,809,916 | 3/1989 | Schwelling | 241/166 |
| 4,981,270 | 1/1991 | Reber | 241/166 |
| 5,178,336 | 1/1993 | Lodovico et al. | 241/99 |

*Primary Examiner*—John Husar
*Attorney, Agent, or Firm*—Friedrich Kueffner

[57] ABSTRACT

A paper shredder includes a pair of cutting rollers and individual strippers mounted on support rods. The strippers extend essentially from the lower and upper outer sides of the cutting mechanism between the cutting disks to the respective roller body. The strippers preferably have crowned stripper portions. A stripper is arranged at the lower side of the cutting mechanism in each gap formed between two adjacent cutting disks by the comb-like engagement of a cutting disk of the opposite cutting roller. Individual auxiliary strippers engaging in every fourth to fifth cutting roller gap are arranged on the upper side of the cutting mechanism. The support rods for the strippers are arranged from the respective outer diameter of the cutting disks at a distance to form openings, wherein the distance is preferably two to ten times the width of the cutting roller gap. For connecting the auxiliary strippers to the support rods, each auxiliary stripper is provided with claw-shaped indentations arranged preferably approximately at the same level, wherein the indentations are located opposite each other and facing outwardly, and wherein the two support rods located immediately opposite each other determine the width of the material intake gap and simultaneously serve the function of a finger guard.

15 Claims, 2 Drawing Sheets

PAPER SHREDDER

BACKGROUND OF THE INVENTION

1. Field of the Invention

The present invention relates to a paper shredder with a pair of cutting rollers and individual strippers mounted on support rods. The strippers extend essentially from the lower and upper outer sides of the cutting mechanism between the cutting disks to the respective roller body. The strippers preferably have crowned stripper portions.

2. Description of the Related Art

The configuration and arrangement of stripper elements for paper shredders operating according to the cutting roller principle have undergone intensive development in the past decade. In addition to the further development of the stripper elements arranged between the cutting disks, solutions have been proposed increasingly in recent years in which additional stripper elements are provided directly on the outer diameter of the cutting disks.

These solutions prevented that cut particles stuck between strippers and cutting disks, which over time resulted in increased friction and a higher ,contact pressure and frequently led to blockage of the cutting mechanism. However, these known solutions are more complicated and expensive and, when the installed power remained the same, a reduction of the available cutting power occurred.

SUMMARY OF THE INVENTION

Therefore, it is the primary object of the present invention to provide a paper shredder with strippers for cut material in which, particularly when cutting thick stacks of printed matter, the friction losses which would negatively affect the installed cutting power are significantly reduced. In addition, the paper shredder should not be technically complicated and the cutting mechanism should be easier to assemble and maintain.

In accordance with the present invention, a stripper is arranged at the lower side of the cutting mechanism in each gap formed between two adjacent cutting disks by the con%b-like engagement of a cutting disk of the opposite cutting roller. Individual auxiliary strippers are arranged on the upper side of the cutting mechanism, however, these auxiliary strippers do not engage in all cutting roller gaps, but preferably in every fourth to fifth gap. The support rods for the strippers are arranged from the respective outer diameter of the cutting disks at a distance to form openings, wherein the distance is preferably two to ten times the width of the cutting roller gap. For connecting the auxiliary strippers to the support rods, each auxiliary stripper is provided with claw-shaped indentations arranged preferably approximately at the same level, wherein the indentations are located opposite each other and facing outwardly, and wherein the two support rods located immediately opposite each other determine the width of the material intake gap and simultaneously serve the function of a finger guard.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
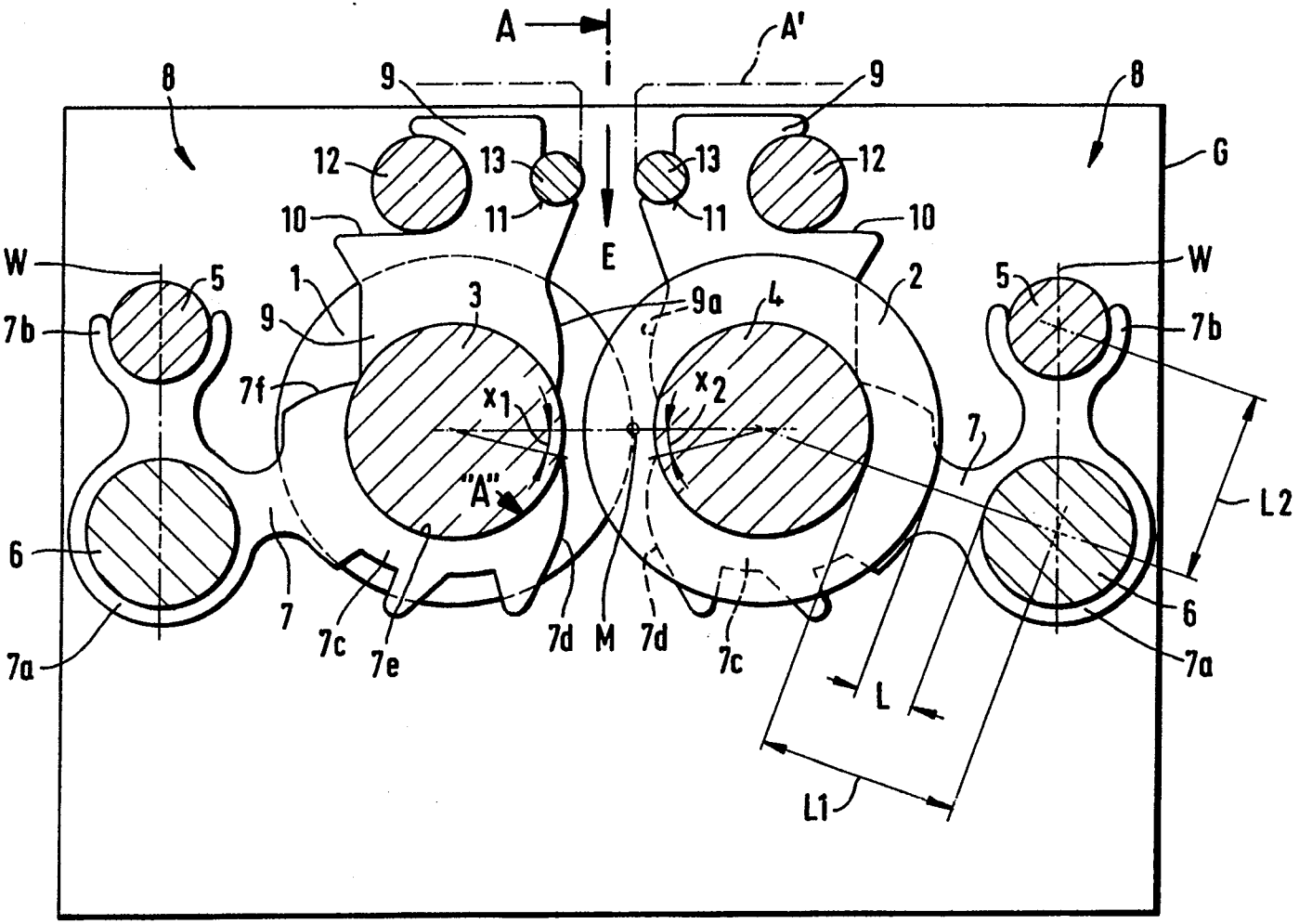
FIG. 1 is a cross-sectional view of the cutting mechanism of a paper shredder according to the present invention.

FIG. 1 of the drawing is a schematic sectional view of the preferred embodiment of the cutting mechanism of a paper shredder according to the present invention. As shown in FIG. 1, the cutting mechanism includes two cutting roller bodies 3, 4 and cutting disks 1, 2 which are arranged on the cutting roller bodies 3, 4, respectively, and mesh into each other like a comb. Strippers 7 are mounted on support rods 5, 6 and auxiliary strippers 9 are mounted on support rods 12, 13. The cutting roller bodies 3, 4 and the support rods 5, 6 and 12, 13 are arranged between and supported by bearing plates G. The support rods 12, 13 additionally serve as spacer members for the cutting mechanism.

Figure 3:
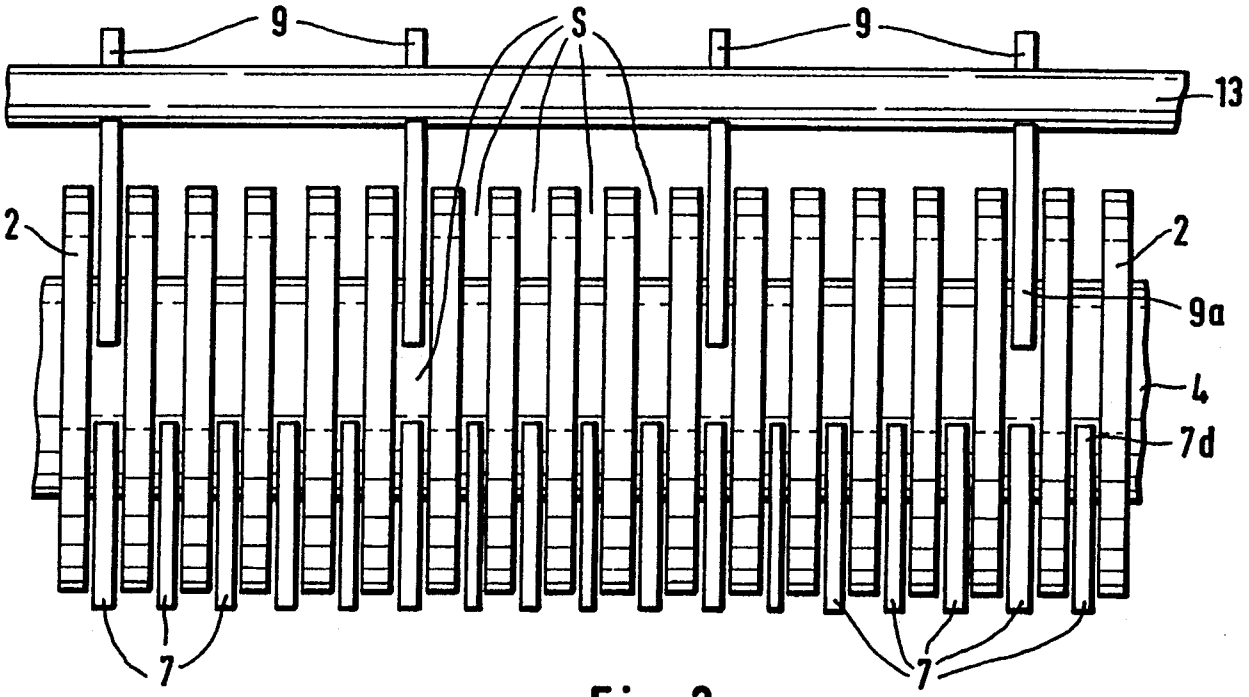
FIG. 3 is a sectional side view, along sectional line A—A of FIG. 1 of the paper shredder cutting mechanism, specifically showing the arrangement of the strippers and auxiliary strippers.

A stripper 7 is arranged on the lower side of the cutting mechanism between each cutting roller gap S formed between two adjacent cutting disks 1 and 2 by the comb-like engagement of a cutting disk 1 or 2 of the opposite cutting roller 3 or 4, respectively. In accordance with a novel feature of the present invention, individual auxiliary strippers 9 are arranged at the upper side of the cutting mechanism not in each cutting roller gap S of the two cutting rollers 3, 4, but preferably only in every fourth or fifth cutting roller gap S, as particularly illustrated in FIG. 3.

In addition, the support rods 6 for the strippers 7 are arranged from the respective outer diameter of the cutting disks 1 and 2 at a distance L in order to form openings, wherein the distance L is preferably two times to ten times the width of the cutting roller gap S.

In addition, each auxiliary stripper 9 is provided in its upper portion with claw-shaped indentations 10 and 11 for support on the support rods 12 and 13, wherein the indentations 10 and 11 are located approximately on the same level and opposite each other and are directed outwardly. The two support rods 13 which are arranged immediately opposite each other determine the width of the material intake gap E and simultaneously serve as a finger guard.

Guide plates of a cutting mechanism cover A′ project into the material intake gap E. The guide plates form a small gap and rest against the support rods 13, wherein the support rods 13 slightly protrude into the material intake gap E.

All of the above-mentioned features solve the problems of existing paper shredders in an excellent manner. In addition to lowering the friction losses and a simpler assembly of the individual elements of the paper shredder, there is the advantage that particles and dust resulting from cutting cannot back up, particularly in the material intake gap E during reverse operation.

Figure 2:
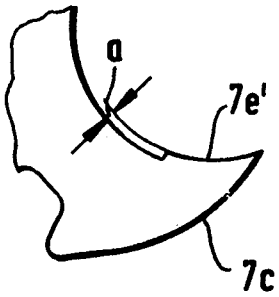
FIG. 2 shows, on a larger scale, the detail marked "A" in FIG. 1.

In accordance with an advantageous further development of the present invention, the inner side *7e* of each stripper 7 resting against the respective cutting roller body 3 or 4 has in the stripping area *7d* a projection *7e* which rests directly against the cutting roller body and a slightly recessed portion extending to the end of the stripper and forming an annular gap a, shown in FIG. 2. This feature can be analogously provided in the auxiliary strippers 9, The size of the annular gap a is selected in such a way that any bending of the cutting rollers and/or of the support rods 6 will not cause the inner portions *7e* of the strippers to rub against the roller bodies 3 or 4.

In the illustrated embodiment, each stripper 7 is composed of a stripper half shell *7c*, a stripper seat *7a* connected to the half shell *7c* and mounted on the support rod 6, followed by a stripper claw *7b* surrounding the support rod 5, wherein the claw *7b* is preferably mounted so as to be directed upwardly, and finally a stripper back *7f* extending at an obtuse angle relative to the respective cutting roller body 3 or 4.

The length L1 between the inner side *7e* of the stripper half shell *7c* and the center of the stripper seat *7a* is advantageously smaller or equal to the length L2 between the center of the stripper seat *7a* and the stripper claw *7b*.

In accordance with another advantageous further development, the crowned stripper portion *7d* of each stripper 7 is outwardly curved from the tip resting against the cutting roller body 3 or 4, such that particles adhering to the cutting disks 1 or 2 impinge at the same angle at each location of the crowned portion. The curved portion extends at least to the range of the outer diameter of the cutting disk 1 or 2. This feature is also provided on the stripping portion *9a* of the auxiliary strippers 9.

In accordance with an additional feature, the axes of the support rods 5 and 6 are arranged on a common line of influence W which is directed against or compensates the force flux direction from the stripping pressure.

The tips of the stripping portions *7d* are arranged resting against the respective cutting roller 3 or 4 at different distances $x_1$, $x_2$ from the cutting mechanism middle M. This feature significantly further increases the already achieved improved efficiency, i.e., a substantially reduced cutting force loss. This is because this feature produces the advantage that the stripping pressures during reverse operation of the cutting mechanism do not load the motor during startup simultaneously, but rather successively.

In addition to the advantages described above, there is the additional advantage that the features of the present invention make it possible that, for example, during reverse operation, the cut printed matter is discharged without backup from the material intake gap E. In that case, any smaller and larger particles or particle strips which have already been cut or have been severed from cut printed matter, can unimpededly travel between the auxiliary strippers 9 which are arranged with gaps therebetween. Simultaneously, the particles or particle strips are prevented from being packed together. The smaller particles can fall through the gaps between the support rod 6 and the cutting disks 1 or 2, while the particle strips and larger pieces of printed matter are held back in the upper free space 8 which is sufficiently protected by the support rods 5, 6 and the strippers 7 supported by the support rods 5, 6 relative to the space arranged below for collecting the cut material. During further forward operation, the particles and larger pieces can then again be individually cut in the cutting mechanism.

The invention is not limited by the embodiments described above which are presented as examples only but can be modified in various ways within the scope of protection defined by the appended patent claims.

I claim:

1. A paper shredder comprising a cutting mechanism with a pair of cutting rollers, each cutting roller having a cutting roller body, a plurality of support rods and a plurality of individual strippers mounted on the support rods, the strippers extending essentially from a lower and an upper outer cutting mechanism side between cutting disks of the cutting rollers and to the cutting roller bodies, wherein the strippers comprise a set of first strippers at the lower cutting mechanism side, each first stripper extending between a gap formed between two adjacent cutting disks by a con, b-like engagement of a cutting disk of the oppositely located cutting roller, and a set of second auxiliary strippers at the upper cutting mechanism side, the second strippers extending only into some of the gaps formed by the cutting disks, wherein the support rods for the first strippers are arranged from the outer diameter of the corresponding cutting disks at a distance to form an opening, each second stripper having inner and outer claw-shaped indentations for receiving the support rods, the indentations being located approximately on the same level and opposite each other, the oppositely located support rods forming a material intake gap.

2. The paper shredder according to claim 1, wherein the oppositely located support rods form a finger guard.

3. The paper shredder according to claim 1, wherein the second strippers are provided in every fourth or fifth gap between cutting disks.

4. The paper shredder according to claim 1, wherein the distance between the support rods for the first strippers and the outer diameter of the cutting disks is two to ten times a width of the cutting roller gap.

5. The paper shredder according to claim 1, wherein each first stripper has an inner side facing the cutting roller body, the inner side having a projection in direct contact with the cutting roller body and a recessed portion extending from the projection to an end of the first stripper, the recessed portion forming a gap between the first stripper and the cutting roller body.

6. The paper shredder according to claim 5, wherein the annular gap has a size selected such that bending of the cutting rollers and of the support rods does not cause the inner side of the first stripper to contact the cutting roller body.

7. The paper shredder according to claim 1, wherein each first stripper comprises a stripper half shelf facing the cutting roller body, a stripper seat for mounting on one of the support rods, the stripper seat being connected to the stripper half shell, and an upwardly open stripper claw for receiving another of the support rods, and wherein the stripper half shell, the stripper seat and the stripper claw are arranged in a L-shape.

8. The paper shredder according to claim 7, wherein a length between the inner side of the first stripper and the center of the stripper seat is smaller than or equal to a length between the center of the stripper seat and the center of the stripper claw.

9. The paper shredder according to claim 7, wherein the first stripper further has a stripper back, the stripper back extending at an obtuse angle relative to the cutting roller body.

10. The paper shredder according to claim 7, wherein each first stripper comprises a crowned stripping portion extending toward a center of the cutting mechanism and resting against the cutting roller body, the stripping portion having a tip, the stripping portion being curved outwardly from the tip, such that particles adhering to the cutting disk impinge at the same angle against the crowned portion, wherein the curved portion extends at least to the outer diameter of the cutting disk.

11. The paper shredder according to claim 10, wherein the tips of the stripping portions of opposite first strippers are arranged at different distances from the cutting mechanism middle.

12. The paper shredder according to claim 7, wherein the support rod mounted in the stripper claw and the support rod mounted in the support seat are located on a common line of influence for counteracting and compensating a force flux direction from the pressure exerted by the stripper.

13. The paper shredder according to claim 1, further comprising a cutting mechanism cover with guide plates projecting into the material intake gap, each guide plate extending to one of the support rods, wherein the support rod projects slightly above the guide plate toward the material intake gap.

14. The paper shredder according to claim 1, wherein each auxiliary stripper has a crowned portion and a stripping portion, the stripping portion being outwardly curved such that cut particles adhering to the cutting disks impinge at the same angle against all locations of the crowned portion.

15. The paper shredder according to claim 1, the cutting mechanism being mounted in a housing having walls, the first strippers and the support rods supporting the first strippers being mounted in the housing such that only small particles can drop from a free space defined above and laterally of the cutting mechanism down into a collecting space for cut material underneath the cutting mechanism.

* * * * *